United States Patent [19]

Rathi

[11] 4,318,488

[45] Mar. 9, 1982

[54] METHOD OF EXTENDING A JIB OF A TELESCOPIC CRANE

[75] Inventor: Ram N. Rathi, Cedar Rapids, Iowa

[73] Assignee: Harnischfeger Corporation, West Milwaukee, Wis.

[21] Appl. No.: 172,955

[22] Filed: Jul. 28, 1980

[51] Int. Cl.[3] ..... B66C 23/62

[52] U.S. Cl. ..... 212/270; 212/177

[58] Field of Search ..... 212/175, 177, 188, 270

[56] References Cited

U.S. PATENT DOCUMENTS

| | | | |
|---|---|---|---|
| 3,125,227 | 3/1964 | Kauffman et al. | 212/177 |
| 3,698,569 | 10/1972 | Lamer et al. | 212/177 |
| 4,091,936 | 5/1978 | Wuerflein et al. | 212/177 |
| 4,141,455 | 2/1979 | Henderson et al. | 212/188 |

*Primary Examiner*—Robert G. Sheridan

*Attorney, Agent, or Firm*—James E. Nilles

[57] ABSTRACT

Method for extending a jib of a telescopic crane which jib may be stored alongside a base section when not in use. The crane boom comprises at least the base section, a second section with linearly extendable power means, an extension pivotably mounted on the outer end of the second section and stored alongside that section and the base section, and a jib releasably attached to both the base section while in storage and to the extension while in use. To set up the crane for operation, the power means extends the second section forward from the base section, which extends in a forward direction the extension pivotally attached to the second section. This extension places the outer end of the extension in vertical alignment with the inner end of the jib. The extension and jib are then connected along their lengths and the jib is released from its storage position on the base. The inner end of the extension is pivoted around the outer end of the second section and the inner end of the jib is pivoted around the outer end of the extension. Both the extensions and the jib are fixed in an operative position. If the jib is not required, it is left in its attached position on the base, and the base section, second section, and boom extension may be operated independently.

30 Claims, 17 Drawing Figures

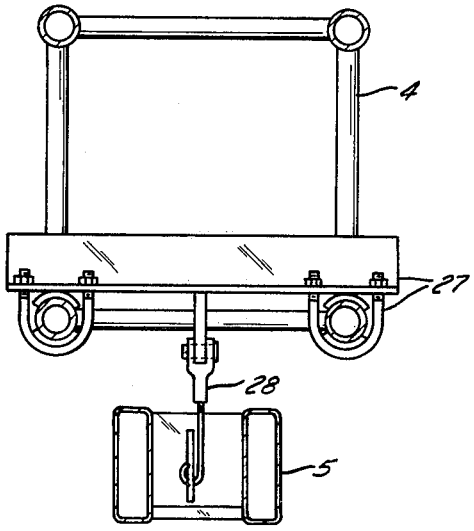
FIG. 13
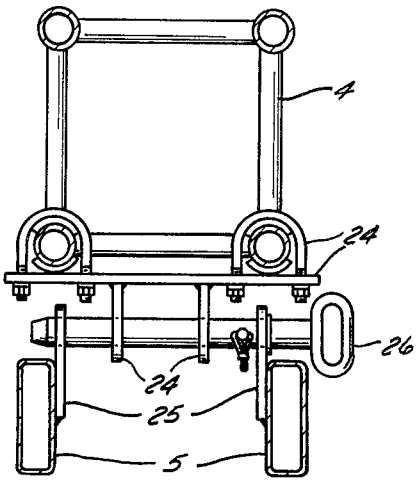
FIG. 14
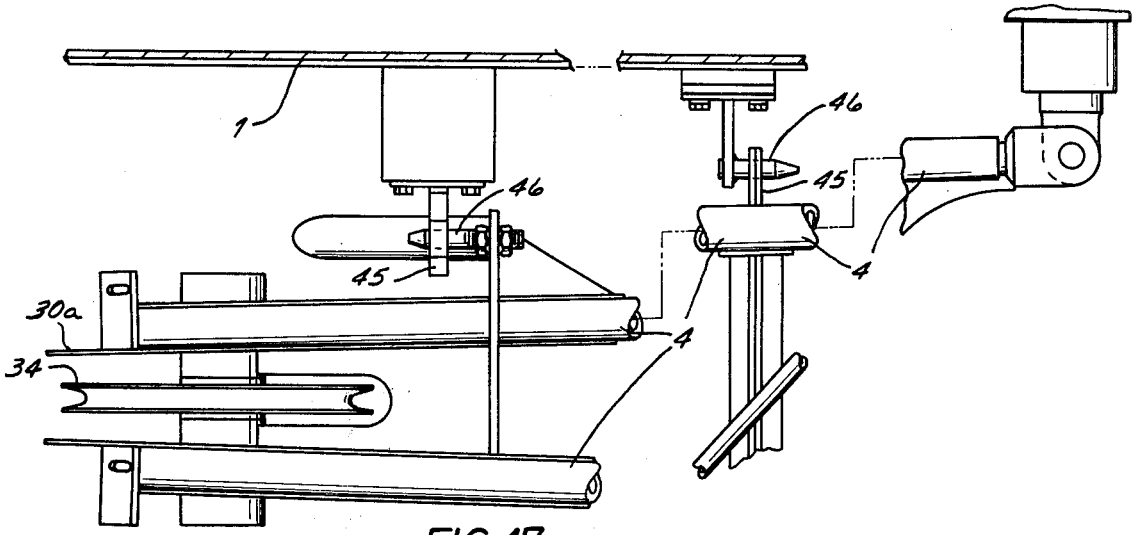
FIG. 17
FIG. 16
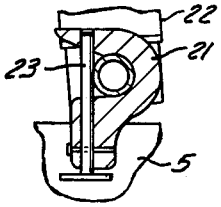
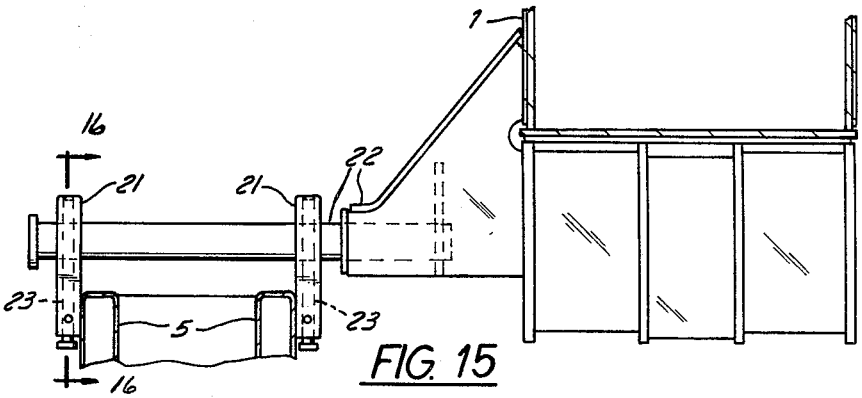
FIG. 15

METHOD OF EXTENDING A JIB OF A TELESCOPIC CRANE

BACKGROUND OF THE INVENTION

1. Field of Use

This invention relates generally to multisection telescopic booms such as used on mobile cranes and the like. In particular, it relates to a method of extending a jib section which is releasably mounted to the base of a boom, permitting relatively long boom extensions to be used.

2. Description of the Prior Art

Various types of multisection telescopic crane booms are known which have a base section, a second section with power means, an extension, and a jib detachably mounted on the base section. The detachable mounting of the jib to the base section enables the crane operator to readily attach the jib to the extension if needed, and leave the jib mounted to the base if the jib's additional length is not needed. In the stored position on current crane, a point at the other end of the extension is in vertical alignment with a point at the inner end of the jib. Before being pivotally attached to the extension at this point, the jib is typically attached to the extension thereabove at two other points, after which the extension and jib attached thereto must be pivoted around the end of the outermost telescoping section of the crane. An extension that would be as long as the base section along which it is stored would, in pivoting from its stored position to a position in which it may be used, be obstructed by machinery on the crane or by the crane operator's cab. Thus, the extension is made shorter than what would have been possible without such obstructions. In current cranes, the outer end of the extension goes no farther towards the rear of the crane than the inner end of the jib. As a result, several feet of potential stored extension length, rearward along the base section of the boom, are lost in current cranes of this type.

SUMMARY OF THE INVENTION

A method of extending a jib releasably connected to the base section of a telescoping boom on a crane is provided, wherein an extension of a telescoping section of the boom is longer than extensions currently used on this type of crane.

The method described herein is typically used on a crane having a base section, a second section telescopingly mounted therein, an extension pivotally mounted at the outer end of the second section and stored alongside the base section, and a jib attached to the base section of the boom.

The method comprises telescopingly extending the second section outwardly, which moves the extension pivotally attached to the second section outwardly, until the outer end of the extension is adjacent the inner end of the jib. The jib is attached to the extension and released from its mounting on the base section. The extension is then pivoted into operative alignment with the second section and its position is fixed. The jib, which was attached to and carried along with the extension when the latter was pivoted, is pivotally attached at its inner end to the outer end of the extension and released from its outer attachments to the extension. Finally, the jib is pivoted into operative alignment with the extension and locked into place relative to the extension.

The method in accordance with the invention offers a significant advantage over the prior art arrangement. A long extension on a crane is inherently advantageous compared to a shorter extension. Current cranes with base section-mounted jibs have extensions which are stored alongside the base section and whose lengths are limited because of machinery mounted on such cranes which would prevent the pivoting into an operable position of a long extension. Extensions on these prior art cranes are thus made shorter, with no provision for telescoping them away from the interfering machinery before attaching and pivoting. The new method described herein enables the crane operator to move a telescopable section of a boom forward, thereby moving forward along the base section the extension, pivotally attached to the telescopable section, until it is in position to engage the jib. In this forward position, the extension will not be obstructed in its pivoting around the telescopable section by machinery mounted on the crane in the vicinity of the rear of the base section.

Other objects and advantages of the present invention will appear hereinafter as this disclosure progresses, reference being had to the accompanying drawings.

BRIEF DESCRIPTION OF THE DRAWINGS

FIG. 13 is an enlarged view of the link and second bracket connecting the jib and extension taken along the line 13—13 of FIG. 10;

FIG. 14 is an enlarged view of the slotted bracket, first bracket, and pivot pin connecting the jib and extension taken along line 14—14 of FIG. 11;

FIG. 15 is an enlarged view of the pivot hooks and second storage bracket connecting the jib and base section taken along line 15—15 of FIG. 10;

FIG. 16 is an enlarged view of the pivot hooks and retaining pins therein taken along line 16—16 of FIG. 15;

FIG. 17 is an enlarged top plan view of the extension sheave at the outer end of the extension, and the extension transport brackets and pins therefor taken along line 17—17 of FIG. 1.

DESCRIPTION OF A PREFERRED EMBODIMENT

Figure 5:
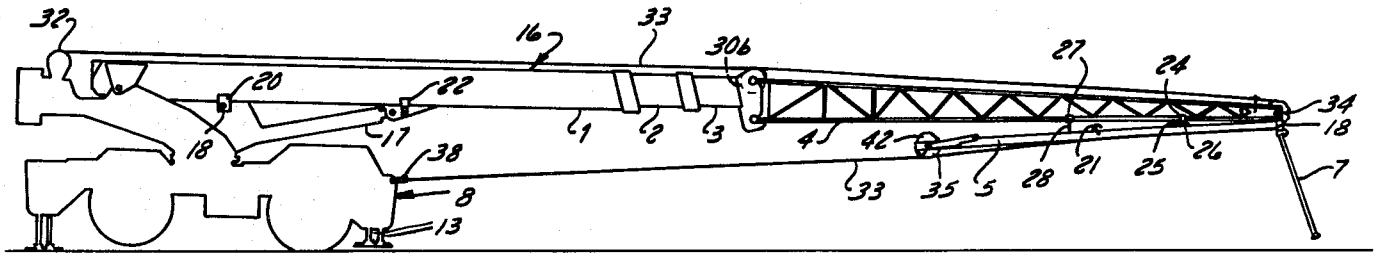
FIG. 5 is a side elevational view of a mobile crane with an extension in operative alignment with a telescopic boom, and with a jib section connected thereto at two points along their respective lengths.
Figure 6:
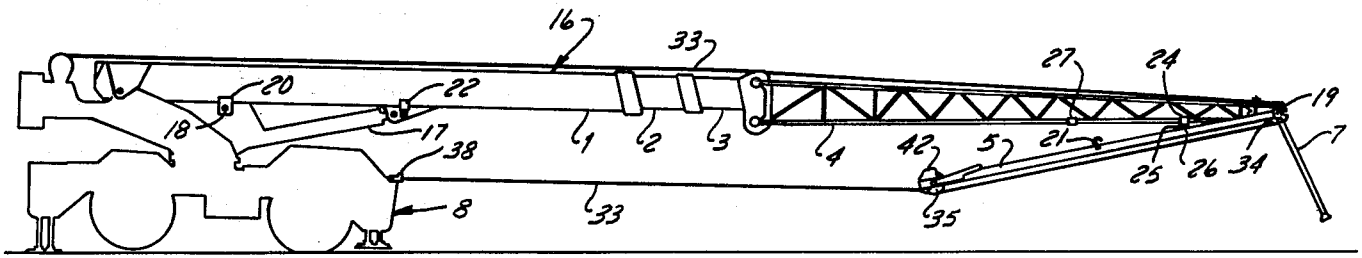
FIG. 6 is a side elevational view of a mobile crane similar to FIG. 5 but showing the jib pivotally attached to the extension, and further attached thereto at one point along their respective lengths with a mast in an extended position.
Figure 7:
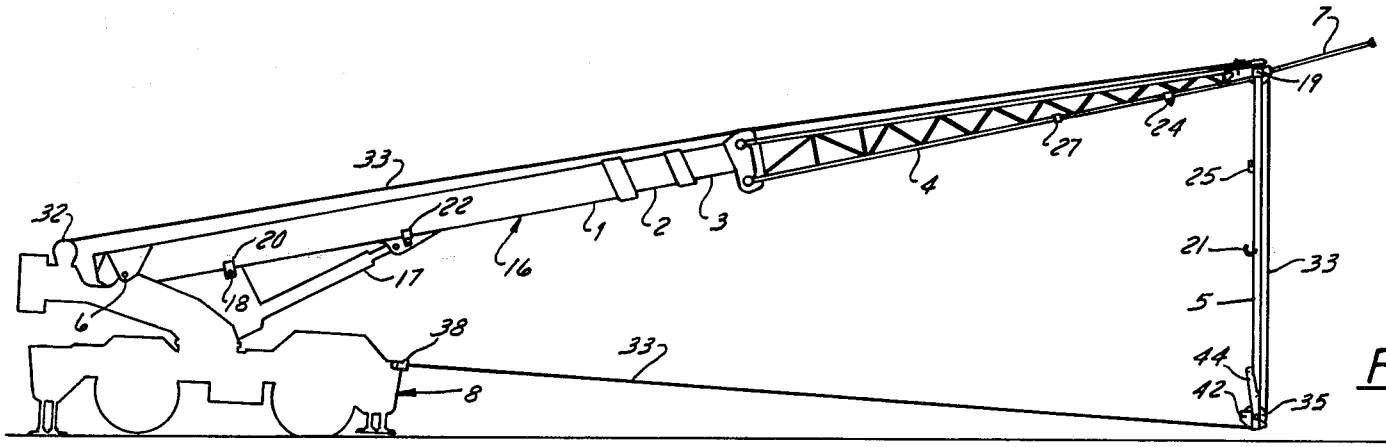
FIG. 7 is a side elevational view of a mobile crane showing the jib pivotally attached to the extension and hanging down therefrom.

The method for extending a jib of a telescoping boom described herein is applicable to any crane with as few as four sections, that is, a base section, a second or other section telescopingly movable within the base section, an extension, and a jib. However, this embodiment will describe a crane in five sections; a base section 1, a first section 2, a second section 3, an extension 4, and a jib 5 (FIGS. 5-7).

Figure 8:
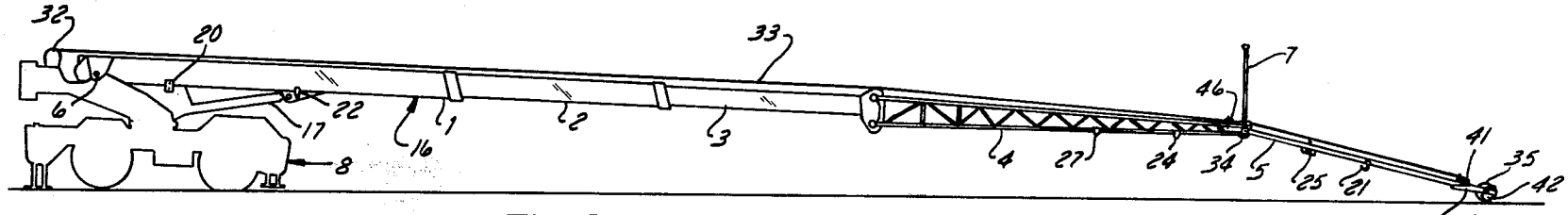
FIG. 8 is a side elevational view of a mobile crane with its telescopic boom sections substantially extended, the extension in operative alignment with the telescopic sections, and the jib being placed in operative alignment by lowering the boom.

In describing one of the five boom sections as having an inner base or outer point end, the reference point is the pivotal mounting 6 of the base section 1 when all sections are in their normal operative alignment (FIG. 8). For example, the inner end of extension 4 is that end where extension 4 meets second section 3 and the outer end of extension 4 is that end where extension 4 meets jib 5.

Figure 4:
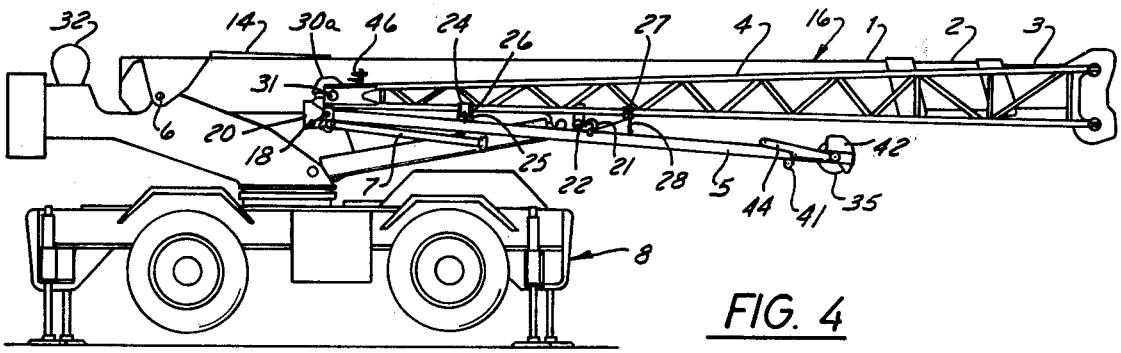
FIG. 4 is a view similar to FIG. 3 but showing the extension and jib telescoped still further forward to a position from where they may be pivoted around the outwardmost telescopic section to place the extension in operative alignment with the boom.

The apparatus typically used in the method is shown as applied to a mobile unit (FIGS. 1, 2 and 4), which comprises a lower unit 8 such as a self-propelled crane and an upper unit 9 which is mounted for horizontal rotation in either direction on the lower crane unit 8 by means of a conventional turret 10. Crane 8 comprises a chassis 11 on which are mounted ground wheels 12, extendible outriggers 13, and combination driver's and crane operator's cab 14. Upper unit 9 comprises a supporting framework 15 on which is mounted a telescopic boom 16. An internal combustion engine (not shown) drives the ground wheels 12 and the hydraulic pump (not shown), which provides operating fluid for hydraulic boom hoist cylinder 17 to raise and lower telescopic boom 16 in the known manner. Extendible and retractable power means are provided for telescoping the telescopic sections relative to one another and relative to the base section 1 in the known manner.

Figure 1:
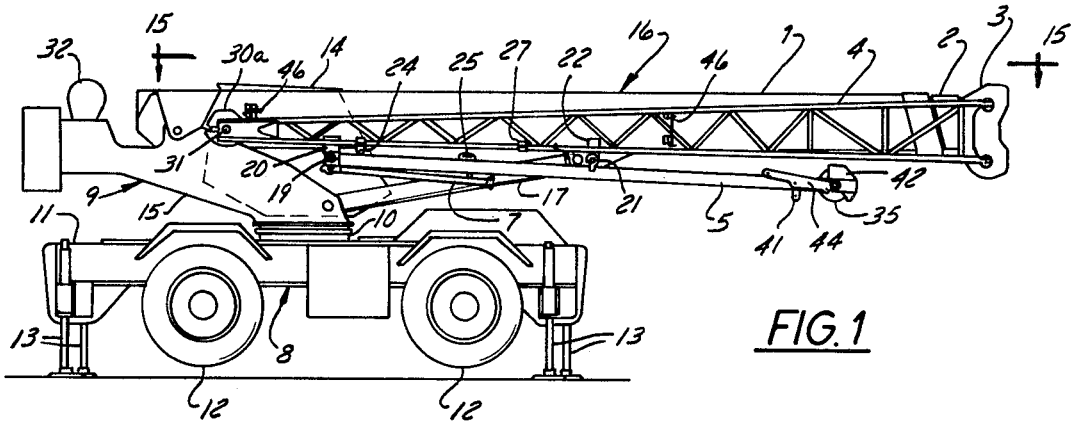
FIG. 1 is a side elevational view of a mobile crane in a stored position having a multisection telescopic main boom, an optionally useable jib, releasably connected to and stored beneath the base section of the main boom, and an extension pivotally mounted at the outer end of the outwardmost telescopic section, for performing the method described herein.

The crane is now described in its stored position (FIG. 1). The first section 2 and second section 3 are telescoped within the base section; first section 2 is telescopingly movable within the base section 1 and second section 3 is telescopingly movable within first section 2. The extension 4 is pivotally mounted about a generally vertical axis at its inner end to the outer end of the second section 3 and is folded back alongside the base section 1, first section 2, and second section 3 (FIG. 1), with its outer end adjacent the inner end of base section 1. The jib 5 is mounted beneath the extension 4 when in its stored position and is attached both at its inner end and also at a point intermediate its length and intermediate the extension's 4 length to the base section 1.

Figure 2:
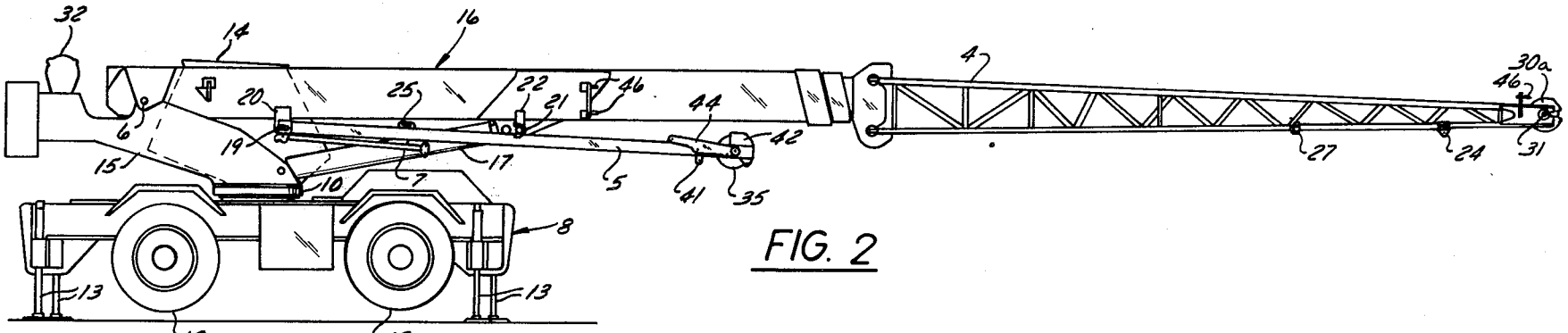
FIG. 2 is a view similar to FIG. 1, but showing the extension pivoted around the outer end of the outwardmost telescopic section in an operative alignment for use without the jib.

Attachment means for the jib 5 while it is in the stored position on the base section 1 are described. The jib 5 is mounted to the base section 1 with its inner end adjacent the inner end of the base section 1. A jib foot pin 19 connects the jib 5 at its inner end to the base through holes 18 at the inner end of the jib to a first base jib storage bracket 20. A pair of pivot hooks 21 attached to jib 5 engage a second base jib storage bracket 22, securing the jib 5 to the base section 1 at a point intermediate the length of both the jib 5 and the base section 1. A retaining pin 23 engages each pivot hook 21 through its open end, and prevents inadvertent slippage of pivot hooks 21 from second base jib storage bracket 22 (FIGS. 15-16). As shown in FIG. 2, the attachment means permits the telescopic boom 16 and extension 4 to be used independently of the jibs while the jib 5 remains in a stored position on base section 1.

Figure 12:
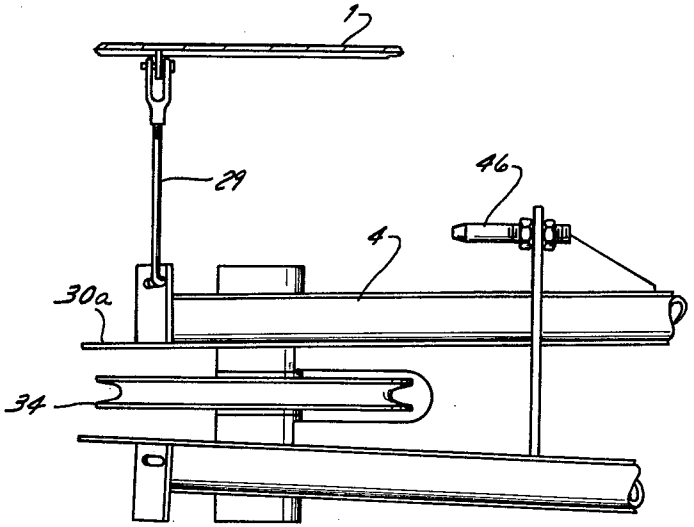
FIG. 12 is an enlarged top plan view of the extension sheave at the outer end of the extension and the retaining hook therefore taken along line 12—12 of FIG. 10, when the extension is in the position as shown in FIG. 3.
Figure 10:
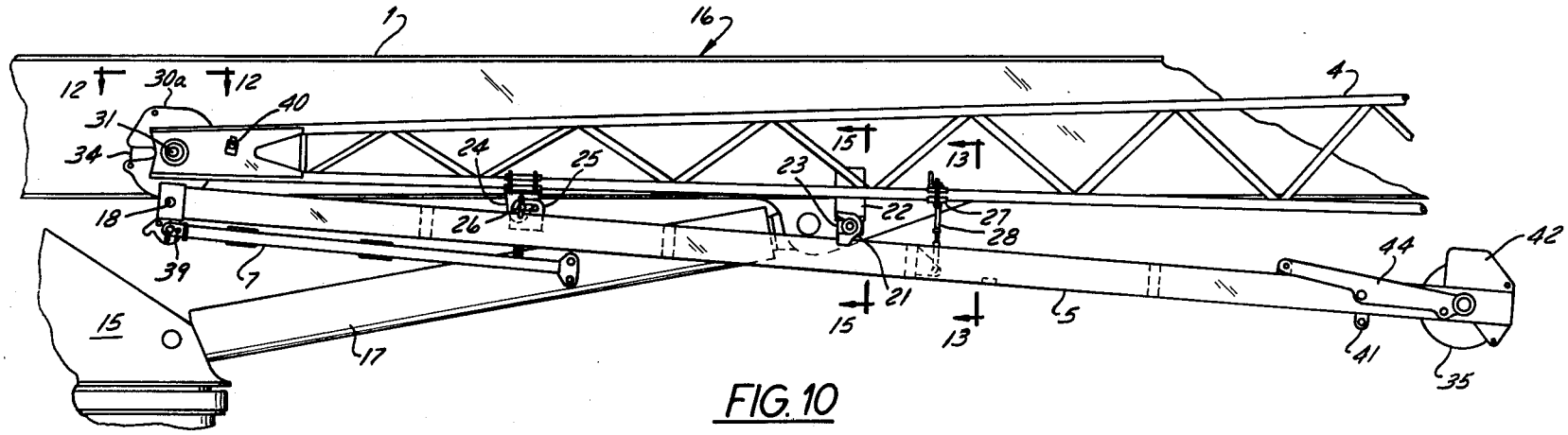
FIG. 10 is an enlarged, side elevational view showing the extension and jib attached thereto along their respective lengths.
Figure 11:
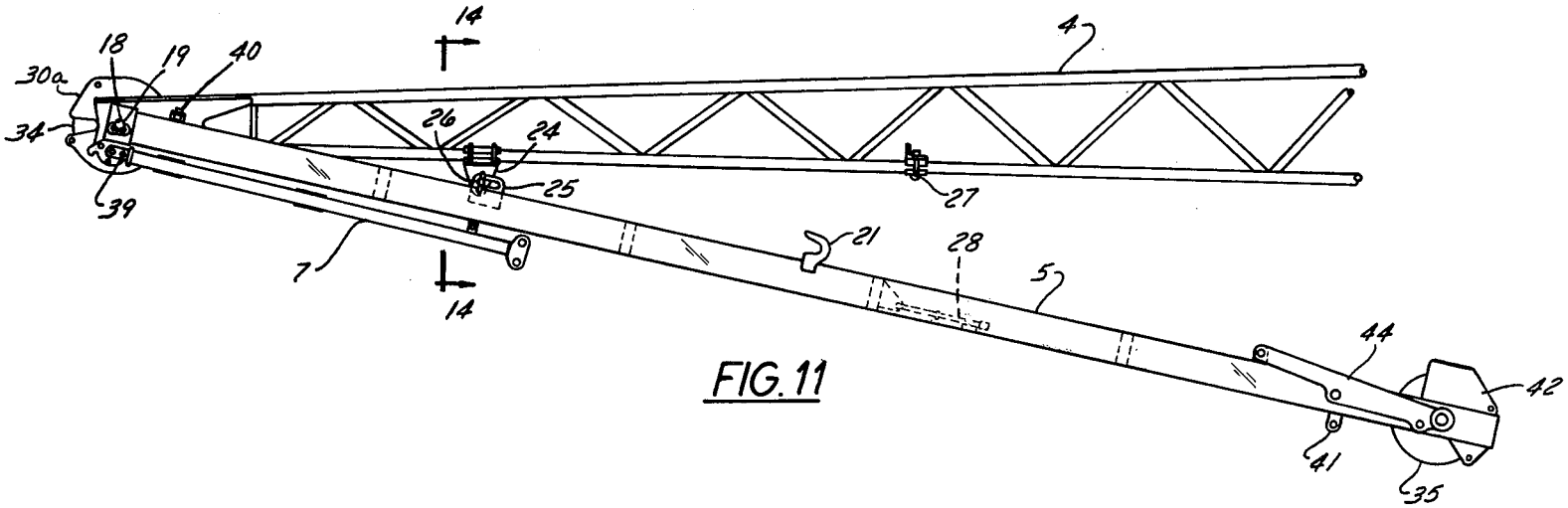
FIG. 11 is an enlarged portion of the extension and jib as shown in FIG. 6 but from the opposite side and with the mast in a stored position.

Means for attaching the jib 5 to the extension 4 comprise a plurality of links and connecting brackets which are in vertical alignment when the inside end of the jib 5 is directly under the outside end of the extension 4. In this position, a first bracket 24 on the extension 4 is in alignment with a slotted bracket 25 on jib 5 so that the inside or foot end of the jib 5 may be rotated up enough to install a pivot pin 26 through first bracket 24 and slotted bracket 25 (FIGS. 10, 14). In addition, a second bracket 27 on the extension 4 is in alignment with a pivotally-mounted link 28 on jib 5 so that link 28 may be swung up from a stored position on the jib 5 substantially parallel with the jib's length to a position approximately perpendicular to the jib 5 and releasably connected to second bracket 27 (FIGS. 10, 11, 13). A retaining hook 29 releasably connects extension 4 to base section 1 at extension head sheave 34 to prevent rotation of the extension 4 about its vertical axis during the attachment of the jib 5 thereto (FIG. 12).

When the extension 4 is pivoted around the outer end of second section 3 to a position in which the extension 4 and second section 3 are in operative alignment, as shown in FIG. 5, means for fixing the position of extension 4 are required. These means comprise receiving apertures adjacent the outer end of second section 3 and the inner end of extension 4, which are in alignment when extension 4 and second section 3 are in operative alignment, and foot pins inserted through the aligned apertures in the two sections to prevent movement of extension 4 about its vertical axis. A more detailed description of the foot pins and receiving apertures described herein and their use to fix the portion of a boom extension about a generally vertical axis is shown and described in U.S. Pat. No. 4,141,455 issued Feb. 27, 1979 to F. A. Henderson et al entitled "Means for Storing and Connecting Jib on Telescopic Crane Boom", and assigned to the same assignee as the present application.

Means for pivotally attaching the inner end of the jib 5 to the outer end of the extension 4 are described. Holes 18 in the jib 5 for connecting the inner end of the jib 5 to the base section 1, as described hereinabove, are the same holes 18 which are aligned with holes 31 at the outer end of extension 4. Jib foot pin 19, when placed through aligned jib holes 18 and extension holes 31, pivotally attaches the two sections.

Figure 9:
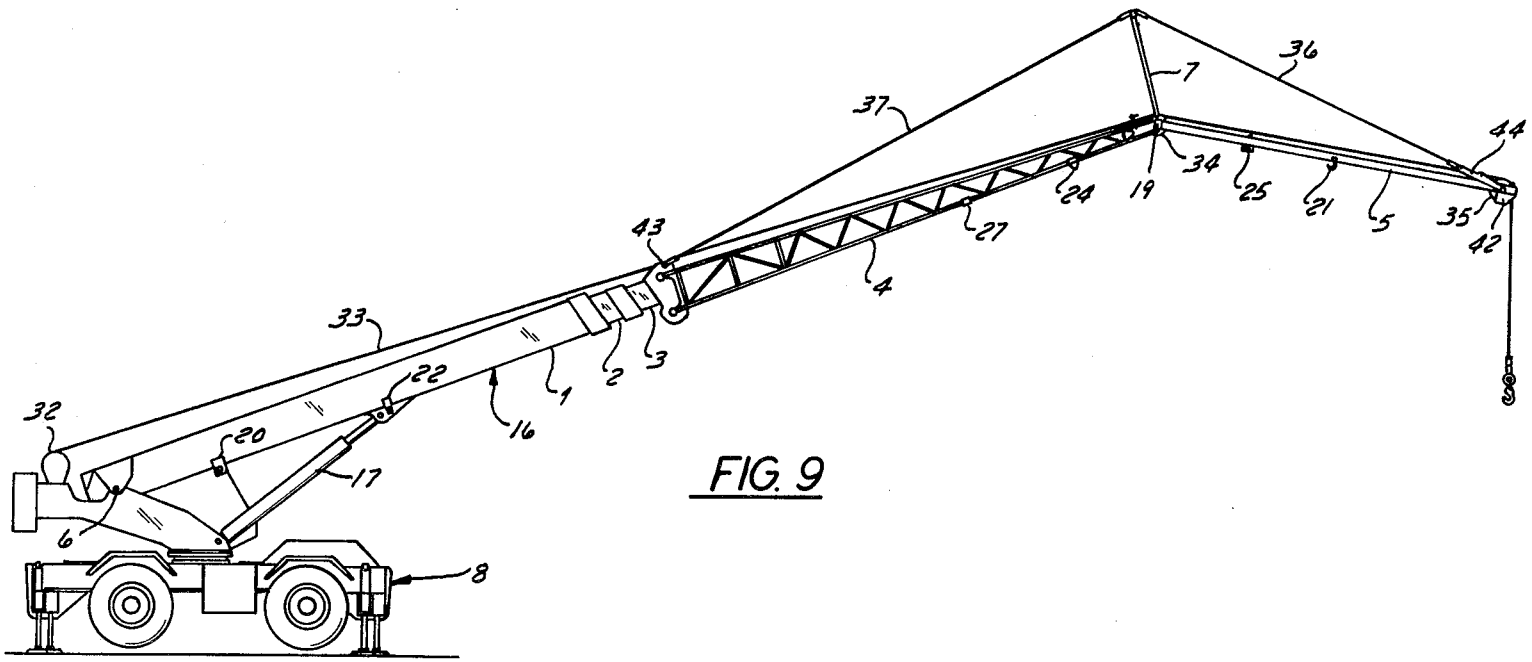
FIG. 9 is a side elevational view of the mobile crane of FIG. 1 after the jib extending method described herein has been utilized to extend the jib section.

Other means for erecting the jib 5 are now described. A powered winch 32 is mounted on the upper unit 9 of the crane adjacent the inner end of the base section 1. A winch cable 33 is extended and retracted by the winch in the known manner, and passes over one or more sheaves including boom head sheave 30*b*, extension sheave 34, and jib point sheave 35, the latter having a jib sheave guard 42. A mast 7 is pivotally mounted at the inner end of the jib 5 and provides, along with front guyline 36 and rear guyline 37, support to the jib 5 in its normal operative alignment (FIG. 9). Front and rear guylines 36 and 37 are both attached to mast 7, and are also attached to jib offset bracket 44 and boom head eye 43, respectively. The mast 7 may be held in a generally upward position without support from guylines 36 and 37 when no external load is placed on the jib 5 by snapper pins 39 attached adjacent the point where mast 7 is pivotally connected to jib 5. Winch cable 33 may be pinned to the lower unit 8 by attachment thereof to lug 38 (FIGS. 6 and 7). Angle stops 40 on extension 4 ensure alignment of holes 18 at the inner end of jib 5 and holes 31 at the outer end of extension 4 so that jib foot pin 19 may be inserted through those holes 18 and 31, permitting pivoting of jib 5 around extension 4 into normal operative alignment.

Figure 3:
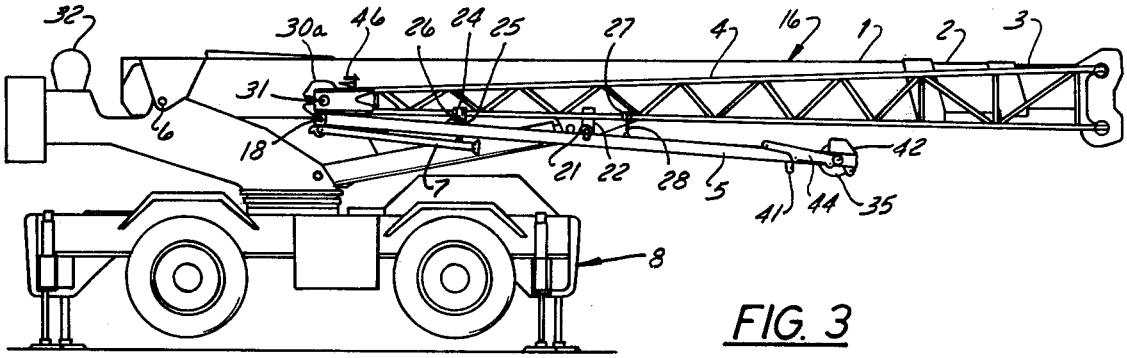
FIG. 3 is a view similar to FIG. 1 but showing the telescoping sections and the extension attached thereto telescoped forward to where the extension and jib are aligned for attachment along their lengths.

The method for extending a jib of a telescoping boom may be described as follows. The crane boom and jib are shown in FIG. 1 in their stored position, wherein extension transport brackets and pins 46 (FIG. 17) engage the base section 1 and extension 4 to prevent pivotal movement of the extension 4 around its vertical axis. First section 2 and second section 3 are telescoped outwardly until the outer end of extension 4 is aligned with the inside end of jib 5 (FIG. 3), wherein first bracket 24 is aligned with slotted bracket 25 and second bracket 27 is aligned with link 28. After telescoping, the extension transport brackets no longer engage the base section 1, and alternate means of preventing the extension from pivoting while the jib 5 is being attached to the extension 4 are provided in the form of a retaining hook 29, pivotally mounted on the base section 1 to engage the extension sheave head guard 30*a* (FIG. 12) when the crane is in the position of FIG. 3. The jib 5 is attached to the extension in two steps. First, pivot pin 26 is inserted through first bracket 24 and slotted bracket 25. Second, link 28 is swung up from its stored position and pinned to second bracket 27 on extension 4.

Jib foot pin 19 is removed from holes 18 in jib 5 and the hole in first base jib storage bracket 20, releasing from its connection to the base section 1, the inner end of jib 5, which is swiveled on pivot hook 21 upwardly sufficiently to engage first bracket 24 and slotted bracket 25 with pivot pin 26. After installation of pivot pin 26, retaining pins 23 are removed from pivot hooks 21, enabling the latter to be disengaged from its storage bracket 22, and retaining hook 29 is disconnected from extension 4. First section 2 and second section 3 are further telescoped (FIG. 4) so that pivot hooks 21 may be disengaged from bracket 22, completing the release of the jib 5 from base section 1. A winch cable 33 engaging boom head sheaves 30*b* should be removed from those sheaves 30*b* before pivoting of the extension 4 around its vertical axis at the outer end of the second section 3, which pivoting may be accomplished manually by attaching a suitable length of rope to the outer end of the extension 4 and controlling the swing of the extension 4 and the jib 5 attached thereto with the rope. The extension 4, after being pivoted with the jib 5 from the position of FIG. 4 to the position of FIG. 5, has receiving apertures therein aligned with receiving apertures in second section 3 through which foot pins are passed, affixing the position of the extension 4 relative the second section 3 as shown in FIG. 5. As stated hereinabove, details of the receiving apertures and footpins therefor are shown and described in U.S. Pat. No. 4,141,455.

The front of the crane 8 is tilted downward by raising the front extendible outriggers 13. Mast 7 is manually moved from its stored position (FIG. 4) to the up-position (FIG. 5) and held thereat by snapper pins 39. Winch cable 33 is routed over boom head sheave 30*b*, extension sheave 34, and jib point sheave 35, and is pinned at its end to lug 38 on lower unit 8, as shown in FIG. 5. The jib is then partially released and pivotally attached to extension 4. The weight on link 28, which with pivot pin 26 supports jib 5 on extension 4, is removed by retracting winch cable 33 with winch 32, or winching up, to a position in which the angle between extension 4 and jib 5 is slightly less than that shown in FIG. 5, and the link 28 is disconnected from second bracket 27 and pivotally returned to its stored position parallel to the jib 5. Winch cable 33 is extended from winch 32, that is, winching down occurs, until the inside of the jib is prevented from pivotal movement about the extension 4 by angle stops 40 thereon, at which point holes 18 at the inner end of the jib and holes 31 at the outer end of extension 4 are aligned for connection by jib foot pin 19, which foot pin 19 permits pivotal movement of jib 5 about a horizontal axis at extension 4 to an operative position. After insertion of jib foot pin 19, pivot pin 26 engaging extension 4 and jib 5 at first bracket 24 and slotted bracket 25 is no longer required or desired, and, after winching up to relieve the load thereon, is removed.

The boom 16 is then raised in the known manner to a height at the outer end of the extension 4 at least high enough to allow the jib 5 to be vertically therefrom (FIG. 7) by winching down. Winch cable 33 is detached at lug 38 and pinned to jib 5 at jib cable eye 41 adjacent the jib's outer end, and boom 16 is extended telescopically to approximately 64 feet.

After winching up to raise the jib 5 approximately 60 degrees from the vertical position, boom 16 is lowered until jib sheave guard 42 touches the ground (FIG. 8). The pivoting of jib 5 into operative alignment with the extension 4 is completed by further lowering the boom 16 until jib 5 and extension 4 form an approximately straight line. Rear guyline 37 is connected to mast 7 and boom head eye 43, providing support for mast 7 so that snapper pins 39, previously the sole means for holding mast 7 in position, may be removed. Front guyline 36 is connected to mast 7 and one of the three eyelets of jib offset bracket 44, the eyelet to which guyline 36 is connected determining the offset of the jib 5, and locking the jib 5 with respect to the extension 4 in operative alignment.

Winch cable 33 is disconnected from jib 5 at jib cable eye 41 and reeved over jib point sheave 35. After lowering front outriggers 13 and levelling the crane 8, the telescopic boom 16 with attached extension 4 and jib 5 is ready for operation (FIG. 9).

Returning the apparatus to a stored position essentially comprises performing the steps hereinabove in reverse order.

RECAPITULATION

The invention provides a method for extending a jib from an extension of a telescoping boom, which jib is releasably attached to the base section of the boom. By permitting the boom extension to be telescoped forward to the point where the extension and jib are to be connected, the extension will not be obstructed in pivoting from its stored to its operative alignment by machinery or the operator's cab on the crane to which the boom is attached. This ability to telescope the extension forward to meet the jib therefore permits the extension to be substantially longer than is possible in the prior art.

What we claim is:

1. A method of operating a telescoping boom pivotable about a horizontal axis near its base and having a base section and another section telescopingly mounted within said base section and also having an extension and a jib; said sections, said extension and said jib when in an extended position each having a base end and a point end in respect to said boom base; wherein said other section is telescoped within said base section, wherein said extension is pivotally mounted about a generally vertical axis at its base end to the point end of said other section and is folded back alongside said base section, and wherein said jib lies along and generally beneath said extension and is releasably attached to said base section, said method comprising the steps of:

(a) extending said other section whereby said extension is carried therewith and until the point end of said extension is adjacent the base end of said jib;
(b) attaching said jib to said extension;
(c) further extending said other section to move said jib and release said jib from said base section;
(d) pivoting said extension about said vertical axis to a position in alignment with said other section and carrying said jib therewith,;
(e) fixing the position of said extension on said other section after pivoting;
(f) pivotally attaching the base end of said jib to the point end of said extension;
(g) pivoting said jib into operative alignment with said extension; and
(h) locking said jib in respect to said extension in said operative alignment.

2. The method of claim 1, wherein said other section is initially extended until bracket means mounted on said extension are in alignment with bracket means on said jib.

3. The method of claim 1, wherein said jib attaching step comprises attaching a pivot pin to a bracket on said extension and to a bracket on said jib and which further comprises attaching a link on said jib to a second bracket on said extension.

4. The method of claim 2, wherein said jib attaching step comprises attaching a pivot pin to a first bracket on said extension and to a slotted bracket on said jib and which further comprises attaching a link on said jib to a second bracket on said extension.

5. The method of claim 1, wherein said jib releasing step comprises removing a jib foot pin attaching the point end of said jib to a first storage bracket on said base section and disconnecting a pivot hook on said jib section from a second storage bracket on said base section, and wherein further telescopingly extending said second section outwardly is carried out whereby said extension and said jib attached thereto are carried therewith and until said pivot hook is moved sufficiently outward of said second storage bracket to permit pivoting of said extension and said jib attached thereto about said generally vertical axis.

6. The method of claim 4, wherein said jib releasing step comprises removing a jib foot pin attaching the point end of said jib to a first storage bracket on said base section and disconnecting a pivot hook on said jib section from a second bracket on said base section, and wherein further telescopingly extending said other section outwardly is carried out whereby said extension and said jib attached thereto are carried therewith and until said pivot hook is moved sufficiently outward of said second storage bracket to permit pivoting of said extension and said jib attached thereto about said generally vertical axis.

7. The method of claim 1, wherein said extension pivoting step comprises attaching a suitable length of rope to said outer end of said extension, removing a winch cable from a sheave at said point end of said other section, and swinging with said rope said extension and said jib attached thereto about said generally vertical axis.

8. The method of claim 6, wherein said extension pivoting step comprises attaching a suitable length of rope to said point end of said extension, removing a winch cable from a sheave at said outer end of said other section, and swinging with said rope said extension and said jib attached thereto about said generally vertical axis.

9. The method of claim 1, wherein said fixing step comprises inserting foot pins through said aligned apertures.

10. The method of claim 8, wherein said fixing step comprises inserting foot pins through said aligned apertures.

11. The method of claim 1, wherein said partially releasing said jib comprises disconnecting a link on said jib from a second bracket on said extension, aligning holes at said inside end of said jib with holes at said outside end of said extension, and inserting a pin through said inside jib holes and said outside extension holes to pivotally attach said jib and said extension, then removing a pivot pin from a slotted bracket on said jib and a first bracket on said extension to permit said jib to pivot and be swung into operative alignment.

12. The method of claim 10, wherein said partially releasing said jib comprises disconnecting said link on said jib from said second bracket on said extension, aligning holes at said inside end of said jib with holes at said outside end of said extension, and inserting a pin through said inside jib holes and said outside extension holes to pivotally attach said jib and said extension, then removing a pivot pin from said slotted bracket on said jib and said first bracket on said extension to permit said jib to pivot and be swung into operative alignment.

13. The method of claim 1, wherein said jib pivoting comprises raising said boom to a height at the outer end of said extension permitting said jib to swing downwardly and hang from said extension outer end, and pivotally raising with a winch cable said downwardly hanging jib to a position in operative alignment with said extension.

14. The method of claim 12, wherein said jib pivoting comprises raising said boom to a height at the outer end of said extension permitting said jib to swing downwardly and hang from said extension outer end, and pivotally raising with said winch cable said downwardly hanging jib to a position in operative alignment with said extension.

15. The method of claim 1, wherein said jib locking comprises erecting a mast between said extension and said jib, and securing said mast.

16. The method of claim 14, wherein said jib locking comprises erecting a mast between said extension and said jib, and securing said mast.

17. A method of operating a telescoping boom pivotable about a horizontal axis near its base and having a base section and another section telescopingly mounted within said base section and also having an extension and a jib; said sections, said extension and said jib when in an extended position each having a base end and a point end in respect to said boom base wherein said other section is telescoped within said base section, wherein said extension is pivotally mounted about a generally vertical axis at its base end to the point end of said other section and is folded back alongside said base section, and wherein said jib lies along and generally beneath said extension and is releasably attached to said base section, said method comprising the steps of:

(a) extending said other section whereby said extension is carried therewith and until the point end of said extension is adjacent the base end of said jib;
(b) attaching a pivot pin to a first bracket on said extension and to a slotted bracket on said jib and which further comprises attaching a link on said jib to a second bracket on said extension;
(c) further extending said other section to move said jib and release said jib from said base section;
(d) pivoting said extension about said vertical axis to a position in alignment with said other section and carrying said jib therewith, a receiving aperture in said other section and a receiving aperture in said extension are in alignment;
(e) fixing the position of said extension on said other section after pivoting;
(f) pivotally attaching the base end of said jib to the point end of said extension;
(g) pivoting said jib into operative alignment with said extension; and
(h) locking said jib in respect to said extension in said operative alignment.

18. The method of claim 17, wherein said other section is initially extended until bracket means mounted on said extension are in alignment with bracket means on said jib.

19. The method of claim 17, wherein said jib releasing step comprises removing a jib foot pin attaching the point end of said jib to a first storage bracket on said base section and disconnecting a pivot hook on said jib section from a second storage bracket on said base section, and wherein further telescopingly extending said other section outwardly is carried out whereby said extension and said jib attached thereto are carried therewith and until said pivot hook is moved sufficiently outward of said second storage bracket to permit pivoting of said extension and said jib attached thereto about said generally vertical axis.

20. The method of claim 18, wherein said jib releasing step comprises removing a jib foot pin attaching the point end of said jib to a first storage bracket on said base section and disconnecting a pivot hook on said jib section from a second storage bracket on said base section, and wherein further telescopingly extending said other section outwardly is carried out whereby said extension and said jib attached thereto are carried therewith and until said pivot hook is moved sufficiently outward of said second storage bracket to permit pivoting of said extension and said jib attached thereto about said generally vertical axis.

21. The method of claim 17, wherein said extension pivoting step comprises attaching a suitable length of rope to said point end of said extension, removing a winch cable from a sheave at said outer end of said other section, and swinging with said rope said extension and said jib attached thereto about said generally vertical axis.

22. The method of claim 20, wherein said extension pivoting step comprises attaching a suitable length of rope to said point end of said extension, removing a winch cable from a sheave at said outer end of said other section, and swinging with said rope said extension and said jib attached thereto about said generally vertical axis.

23. The method of claim 17, wherein said fixing step comprises inserting foot pins through said aligned apertures.

24. The method of claim 22, wherein said fixing step comprises inserting foot pins through said aligned apertures.

25. The method of claim 17, wherein said partially releasing said jib comprises disconnecting a link on said jib from a second bracket on said extension, aligning holes at said inside end of said jib with holes at said outside end of said extension, and inserting a pin through said inside jib holes and said outside extension holes to pivotally attach said jib and said extension, then removing a pivot pin from a slotted bracket on said jib and a first bracket on said extension to permit said jib to pivot and be swung into operative alignment.

26. The method of claim 24, wherein said partially releasing said jib comprises disconnecting said link on said jib from said second bracket on said extension, aligning holes at said inside end of said jib with holes at said outside end of said extension, and inserting a pin through said inside jib holes and said outside extension holes to pivotally attach said jib and said extension, then removing a pivot pin from said slotted bracket on said jib and said first bracket on said extension to permit said jib to pivot and be swung into operative alignment.

27. The method of claim 17, wherein said jib pivoting comprises raising said boom to a height at the outer end of said extension permitting said jib to swing downwardly and hang from said extension outer end, and pivotally raising with a winch cable said downwardly hanging jib to a position in operative alignment with said extension.

28. The method of claim 26, wherein said jib pivoting comprises raising said boom to a height at the outer end of said extension permitting said jib to swing downwardly and hang from said extension outer end, and pivotally raising with said winch cable said downwardly hanging jib to a position in operative alignment with said extension.

29. The method of claim 17, wherein said jib locking comprises erecting a mast between said extension and said jib, and securing said mast.

30. The method of claim 28, wherein said jib locking comprises erecting a mast between said extension and said jib, and securing said mast.

* * * * *